United States Patent [19]

Travers

[11] Patent Number: 4,875,574

[45] Date of Patent: Oct. 24, 1989

[54] INFUSION PACKAGE

[76] Inventor: Barbara E. Travers, 11 Meadow View Dr., Esmond, R.I. 02917

[21] Appl. No.: 315,089

[22] Filed: Feb. 24, 1989

[51] Int. Cl.[4] ..... B65D 29/04

[52] U.S. Cl. ..... 206/0.5; 426/83; 426/80; 426/82

[58] Field of Search ..... 206/0.5; 426/83, 80, 426/82, 77–79

[56] References Cited

U.S. PATENT DOCUMENTS

| | | | |
|---|---|---|---|
| 2,860,989 | 11/1958 | Geisinger | 206/0.5 |
| 3,387,978 | 6/1968 | Major | 206/0.5 |
| 3,895,118 | 7/1975 | Rambold | 206/0.5 |
| 3,899,599 | 8/1975 | Rambold | 206/0.5 |
| 4,726,956 | 2/1988 | Christie | 206/0.5 |
| 4,735,810 | 4/1988 | Dacal | 206/0.5 |

*Primary Examiner*—Joseph Man-Fu Moy

*Attorney, Agent, or Firm*—Robert J. Doherty

[57] ABSTRACT

A package for the infusion of tea, coffee, or other substances comprising a cover having a central panel against which an infusion bag is hingedly attached and a pair of side panels extending laterally from each side thereof to form wings adapted to engage the outer surface of a cup in which the infusion process takes place at laterally spaced positions to give greater positioning stability and convenience in maniuplation and disposal to such package.

9 Claims, 1 Drawing Sheet

INFUSION PACKAGE

BACKGROUND AND OBJECTS OF THE INVENTION

This invention relates to an infusion package for a tea bag and the like in which beverage ingredients such as tea, coffee, soup, or the like are packaged within a porous bag for positioning in hot water or other liquid such that the contents and flavoring thereof may infuse into the liquid medium.

The most commonly used tea bags include a porous pouch or envelope in which tea is packaged and to which a string is connected which in turn terminates in a label or tag. The tag and string are used to manipulate the bag as by immersing it into a cup or pot of hot water or other infusion liquid and especially to withdraw the bag therefrom when the brew has reached the desired strength. Such bags with their attached strings and tags present an awkward packaging problem and make neatly disposing of the wet dripping bag difficult for the user. Also, it is sometimes necessary or desirable in achieving the desired brew strength to manipulate the porous bag as by squeezing the contents therefrom. Utilizing the tag or a spoon as a squeezing element for such task is awkward and can easily result in spills. Accordingly, many devices have been proposed to achieve better manipulation of the wet infusion bag to accomplish the above-indicated desired results. The following U.S. patents are instructive of the state of the art in this regard: U.S. Pat. No. 2,101,225 to Rambold; U.S. Pat. No. 2,591,606 to Reed; U.S. Pat. No. 2,614,934 to Trotman; U.S. Pat. No. 2,698,082 to Maloney; U.S. Pat. No. 2,728,671 to Young et al; U.S. Pat. No. 2,860,989 to Geisinger; U.S. Pat. No. 3,047,397 to Irmscher; U.S. Pat. No. 3,057,729 to Grant; U.S. Pat. No. 3,387,978 to Major; U.S. Pat. No. 3,550,528 to O'-Neill; U.S. Pat. No. 3,797,642 to Dobry; U.S. Pat. No. 3,895,118 to Rambold; U.S. Pat. No. 3,899,599 to Rambold;, U.S. Pat. No. 4,726,956 to Christie; and U.S. Pat. No. 4,735,810 to Dacal.

While such patents describe a number of acceptable packages and ones which particularly propose various solutions for handling hot and wet infusion bags, there remains a need for an infusion package structure which accomplishes further desirable features including some positive means for maintaining the package in a closed position and further for positioning the package on the cop or container walls in which infusion takes place in a more positive manner such that the original or alternate desired positioning thereof is to a greater extent maintained. Such positive closure feature not only makes the package more easily shipped and merchandised but also insures the package can be completely closed and maintained in such position after the infusion bag has been used this presenting a more completely closed and more easily manipulated disposal package.

These and other objects of the invention are accomplished by an infusion package for a tea tag and the like, comprising an outer cover of flexible and at least somewhat waterproof material sheet, said sheet including a main central panel having opposed side and top and bottom edges and a pair of adjacent side panels having inner and outer edges hingedly attached by means of said side panel inner edges to said central panel along the side edges thereof, said panels each having inner and outer surfaces, a porous bag containing beverage infusion material hingedly attached to said central panel at an upper portion thereof for positioning against and generally within the planar extent of the inner surface thereof when said package is in a closed storage position, said side panels adapted to swing to a partial overlapping position with respect to each other with their respective inner surfaces superposed with respect to the central panel inner surface in said close position, and means for holding said package in said closed position, said side panels adapted to swing outwardly from said central panel to an open use position wherein said package may be positioned on the outside surface of a cup with said infusion bag extending over the rim thereof and into said cup with at least portions of the inner surfaces of said side panels contacting the outer cup surface to support said package with respect thereto.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DETAILED DESCRIPTION OF THE INVENTION

Figure 1:
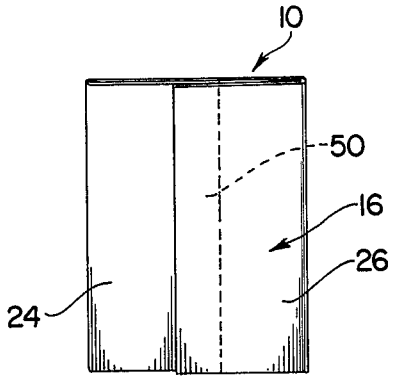
FIG. 1 is a front elevational view of a closed package of the present invention.
Figure 1A:
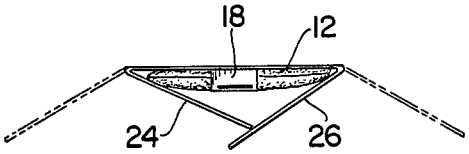
FIG. 1*a* is a top plan view of the package in FIG. 1 showing its normal or rest open position in the solid lines and the extended open position in the dotted lines.
Figure 2:
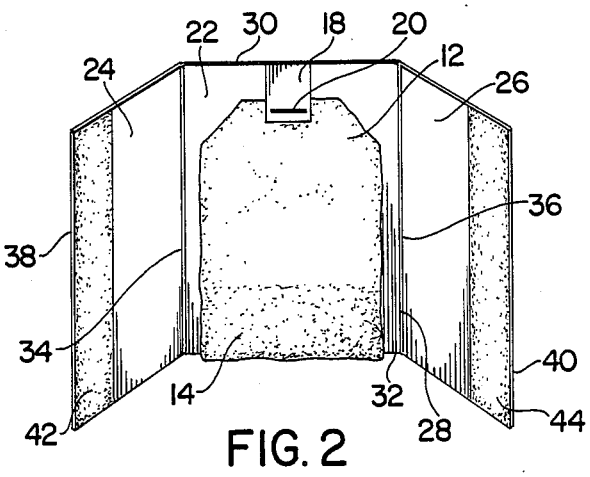
FIG. 2 is a front elevational view similar to FIG. 1 but showing the package in its most fully open or extended position.

The package 10 of the present invention is shown in the closed shipping position in FIG. 1 and in alternate open positions thereof in FIGS. 1*a* and FIG. 2. The package 10 includes a container or bag 12 for the infusion material such as tea 14. The bag is thin, nearly flat and rectangular in shape, and is formed of known tough, high-porous paper such that the tea or other infusion material 14 or at least the flavor and color components thereof may freely pass into a cup or pot of liquid in which the infusion takes place. Such infusion material 14 includes but is not limited to tea, coffee, soup mixtures and non-beverage materials and is hereinafter collectively referred to as the infusion material or tea 14.

The bag 12 is hingedly connnected to the central panel of a cover 16 either directly by a staple or adhesive connection or via a strap 18 as depicted. Such strap 18 is connected to the bag with a staple 20 or other known means and similarly connected to the cover 16 such that the normal bag 12 disposition is superposed in the confines of the cover 16 against and in contact with the central panel thereof. The cover 16 includes a central panel 22 and a pair of side panels 24 and 26 hingedly connected thereto at the side edges 28 thereof. The central panel additionally has a top edge 30 and a bottom edge 32. The inner edges of the side panels 24, 26 are respectively designated by the reference numerals 34 and 36 while the outer terminal edges are designated by the reference numerals 38 and 40 respectively. Accordingly, the side panels 24, 26 are hingedly connected to the central panel 22 vis-a-vis the connection of the edges 34, 36 to the edges 28 of the central panel 22. Most often this connection is by means of a score or fold line since the cover 16 is most commonly formed from a sheet of paper or cardboard stock. Generally, the stock is heat and water resistant or may be given a such resistant coating and alternatively can be formed from plastic or other materials.

Figure 3:
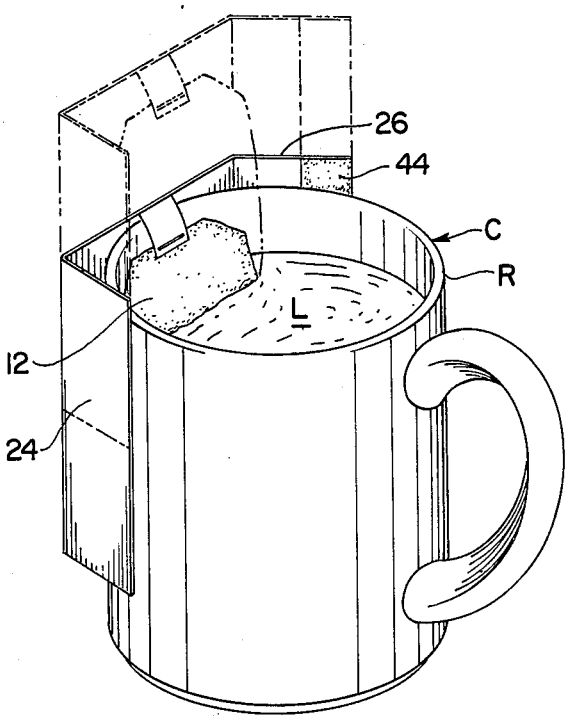
FIG. 3 is a front perspective showing the manner in which the package of the present invention is utilized as an infusion device and illustrates by the dotted line representation an alternate vertical positioning of the package upon the cup.

One of the important features of the present invention is that the side panels 24, 26 inherently or by hinge means (not shown) will normally tend to move to a partially open position as shown by the solid line represtentation in FIG. 1*a* when free from other restraint. In other words, when the cover 16 is forced to its fully open position as shown by the dotted line representation in FIG. 1*a* or by FIG. 2 and placed upon a cup as shown in FIG. 3, the tendency is for the side panels 24, 26 to be inwardly urged into engagement with cup outer wall portions. Generally, this open position is one in which the side panels or wings assume an obtuse angle with respect to the central panel. Although the cup C shown in FIG. 3 has generally straight walls, various other cup or container configurations can be used in combination with the present invention.

Thus the FIG. 3 solid line representation shows the normal position for the package 10 such that the tea 14 housed within the bag 12 is essentially fully immersed in the liquid L to quickly reach the desired brew strength. In such position, it should also be brought out that the bag 12 is centrally and vertically positioned within the cup interior by the opposed side panels 24, 26 acting as stabilizing wings. In addition, because of the wings or side panels 24, 26 contact against the cup exterior surface at laterally spaced positions, the tendency for cover 16 to stay in its initially placed position is enhanced. That is, the tendency for the infusion device and the connected bag to rotate or slip vis-a-vis the cup if the cup is manipulated to transport or drink is reduced or essentially eliminated.

Part of this above-indicated desirable non-slip feature is achieved merely by the side panels 24, 26 lateral spacing and part by the side panels 24, 26 inherent memory to move towards their solid line position once extended. Also, besides more desirably positioning the cover 16 against rotational movement vis-a-vis the cup, the inclusion of the winged structure, that is, the side panels 24, 26, engaging the cup C outer portions, in some cases enables the cover to be positioned in various vertical positions vis-a-vis the cup such as indicated by the FIG. 3 dotted line representation. Thus when it is only desired to partially immerse the bag 12 to produce a weaker brew or to observe the contents thereof flowing into the liquid L, the cover may be positioned higher up on the cup C wall to substantially extend past the rim R thereof.

In order to augment such positioning features as above described, one or both of the inner side panel portions 42 and 44 disposed respectively adjacent to the outer terminal edges 38 and 40 thereof may be provided with an adhesive and/or roughened surface. It is preferable that such adhesive or roughened surface not damage the bag 12 since sometimes in the closed cover position such surface may contact the bag and could either perforate or undesirably stick to the bag. Accordingly, the panel portions 42 and 44 are either provided with a coating, etc. that will not result in such undesirable effects or only one of the side panel portions such as side panel 26 provided with such adhesive coating 44. It should be noted that the side panel 26 as shown in the drawing, is adapted to overlie the side panel 24 such that the adhesive surface 44 in such case not only would contact the outside of the cup C but further can be utilized to adhesively hold the package in its closed position such as shown in FIG. 1 by contact with that portion of the panel 24 outer surface which underlies the adhesive strip 44 depicted on the side panel 26.

Alternatively, particularly when adhesive contact of the side panel portions 42, 44 with the outside of the cup is not desired or sought after, the cover 16 may be effectively adhesively closed by the placement of an adhesive layer on the outer surface thereof proximal the outer edge 38. Such adhesive strip 50 is shown in the FIG. 1 dotted line representation. However, it should be brought out that whichever side panel 24 or 26 is adapted to be partially overlapped is the one that in this case should include the adhesive strip 50, and it may alternatively be either the side panel 24 or the side panel 26 dependent on which one is adapted to be first placed against the bag 12 in the closed position.

Figure 4:
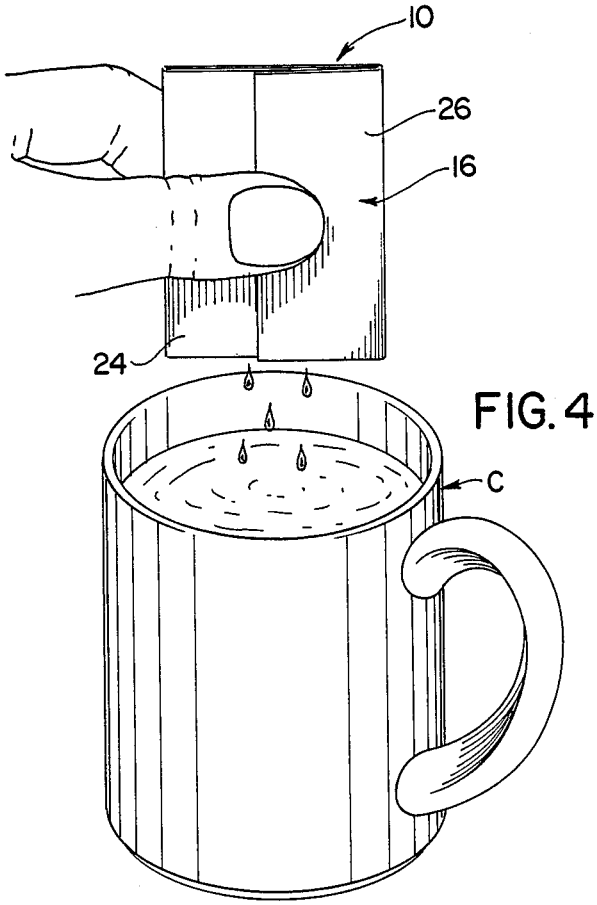
FIG. 4 is view similar to FIG. 3 but showing the manner in which the infusion package may be utilized to squeeze contents from the beverage material contained therein in an easy and particularly socially acceptable manner.

In any of the alternatives as above indicated, the package 10 is easily and uniquely adapted for both disposing and squeezing contents from the bag 12 as pictured in FIG. 4. Therein after the infusion process has started or been completed, the used or partially used bag may be easily disposed of by merely lifting such from the liquid and then overlapping the cover side panels 24 and 26 together and then either disposing of the package or utilizing the cover 16 which envelopes the bag 12 as the mechanism by which further material may be squeezed therefrom in an easy, safe, and socially acceptable manner. Also since the side panels 24 and 26 to some extent overlap each other and both overlap or overlie, that is, are superposed in relation to the central panel, a more enclosed package is presented which assures that liquid squeezed therefrom is directed out the bottom of the package. This is a further advantage over other tea packages which use e.g. a two-part envelope such that a side seam through which liquid could flow is inherently present.

It should also be brought out that the tea bag is essentially completely enclosed by the device of the presnt invention and such characteristic enables the package 10 to be conveniently carried in one's pocket or purse with almost no likelihood of damage. Also although the present package is most useful for use in the above-described manners, it should be brought out that it can also be used in more conventional ways as well. Thus for instance, if is is desired to "dangle" the tea bag 12, that is, bob it up and down or swirl it around in the cup, the wings or side panels 24, 26 can simply be simultaneously grasped in one's hands and manipulated to provide such actions.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An infusion package for a tea tag and the like, comprising an outer cover of flexible sheet, said sheet including a main central panel having opposed side and top and bottom edges and a pair of adjacent side panels having inner and outer edges hingedly attached by means of said side panel inner edges to said central panel along the side edges thereof, said panels each having inner and outer surfaces, a porous bag containing beverage infusion material hingedly attached at an upper portion thereof to said central panel for positioning against and generally within the planar extent of the inner surface of said central panel when said package is in a closed storage position, said side panels adapted to swing to a partial overlapping position with respect to each other with their respective inner surfaces superposed with respect to the central panel inner surface in said close position, and means for holding said package in said closed position, said side panels adapted to swing outwardly from said central panel to an open use position wherein said package may be positioned on the outside surface of a cup with said infusion bag extending over the rim thereof and into said cup with at least portions of the inner surfaces of said side panels contacting the outer cup surface to support said package with respect thereto.

2. The package of claim 1 wherein said side panels are resiliently urged towards their closed position when in their open position so as to firmly grasp said cup.

3. The package of claim 2, wherein said side panels normally assume an acute angular disposition with respect to said central panel when free from restraint.

4. The package of claim 1, said porous bag including adhesive means for holding said package closed.

5. The package of claim 4, said adhesive closing means including providing the inner surface of at least one of said side panel outer edges with a contact adhesive coating.

6. The package of claim 4, said adhesive closing means including providing the outer surface of at least one of said side panel outer edges with a contact adhesive coating.

7. The package of claim 1, wherein at least one of said side panel outer edge inner surfaces are provided with a contact adhesive coating, said adhesive surface adapted to contact said cup outer surface to provide alternate longitudinal positioning thereon.

8. The package of claim 1, wherein both said side panel outer edge inner surfaces are provided with a contact adhesive coating, said adhesive surfaces adapted to contact said cup outer surface to provide alternate longitudinal positioning thereon.

9. The package of claim 1, wherein said material sheet is waterproof.

* * * * *